United States Patent [19]

Yanagawa

[11] Patent Number: 4,662,903

[45] Date of Patent: May 5, 1987

[54] ELECTROSTATIC DUST COLLECTOR

[75] Inventor: Motoo Yanagawa, Tokyo, Japan

[73] Assignee: Denki Kogyo Company Limited, Tokyo, Japan

[21] Appl. No.: 869,784

[22] Filed: Jun. 2, 1986

[51] Int. Cl.[4] ..... B03C 3/01; B03C 3/14

[52] U.S. Cl. ..... 55/126; 55/131; 55/137; 55/145; 55/146; 55/154; 55/155

[58] Field of Search ..... 55/126, 124, 131, 137, 55/146, 155, 154, 141, 143, 145

[56] References Cited

U.S. PATENT DOCUMENTS

| | | | |
|---|---|---|---|
| 2,085,735 | 7/1937 | Brion et al. | 55/137 |
| 3,191,362 | 6/1965 | Bourgeois | 55/126 |
| 3,487,610 | 1/1970 | Brown et al. | 55/155 X |
| 3,520,110 | 7/1970 | Knauer | 55/131 |
| 3,798,879 | 3/1974 | Schmidt-Burbach et al. | 55/155 X |
| 3,828,526 | 8/1974 | King | 55/155 X |
| 3,988,131 | 10/1976 | Kanazawa et al. | 55/126 |
| 4,119,415 | 10/1978 | Hayashi et al. | 55/154 X |
| 4,231,766 | 11/1980 | Spurgin | 55/138 |
| 4,419,107 | 12/1983 | Roydhouse | 55/146 X |

OTHER PUBLICATIONS

Technical Material of Electrostatic Dielectric Air Cleaner, (Technical Material No. IS—001), Ishimori & Co., Ltd.

*Primary Examiner*—Kathleen J. Prunner
*Attorney, Agent, or Firm*—Armstrong, Nikaido, Marmelstein & Kubovcik

[57] ABSTRACT

An electrostatic dust collector is provided with an electrode unit including first and second electrodes arranged to oppose each other across a solid insulator and having positive and negative potentials respectively applied thereto, the second electrode being so disposed that a leading edge portion thereof is located at a position inwardly of a leading edge portion of the first electrode. A gas passageway is formed on a side of the second electrode opposite the first electrode, and an electrically conductive filter element is arranged in the gas passageway so as to be in contact with the second electrode. A gas to be purified, such as air, is forcibly passed through the passageway by a motor-driven fan. The filter element consists of a material, such as steel wool, made up of a multiplicity of fine fibers to provide a large surface area. Owing to its electrical contact with the second electrode, the filter element traps airborne particles on the fine fibers by electrostatic induction.

13 Claims, 17 Drawing Figures

PRIOR ART Fig. 3
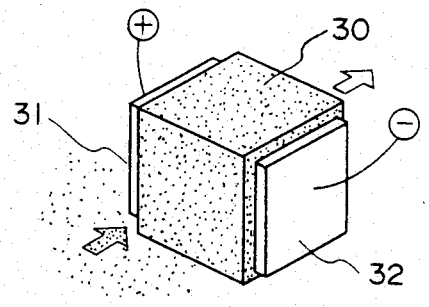
PRIOR ART Fig. 4
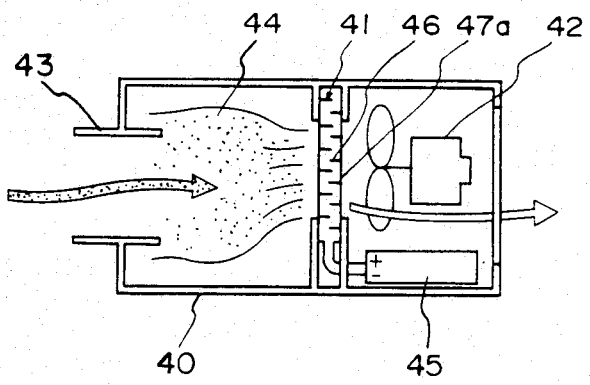
PRIOR ART
Fig. 5a
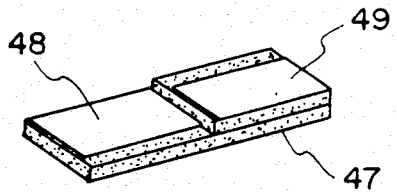
Fig. 5b
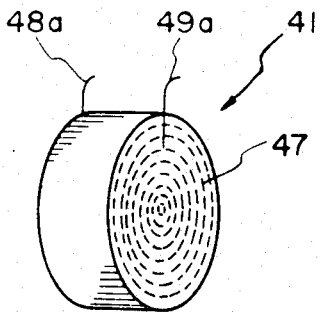

ELECTROSTATIC DUST COLLECTOR

BACKGROUND OF THE INVENTION

This invention relates to an electrostatic dust collector and, more particularly, to an electrostatic dust collector in which extremely small particles of dust can be collected efficiently with an easily replaceable filter, and wherein a short-circuit discharge caused by the application of a high voltage does not occur.

The worsening of municipal air pollution caused by the growth of industry and the overcrowding of cities is a hindrance to productivity in the industrial sector and has a deleterious effect in terms of environment and health in residential areas. Accordingly, pollution preventing measures such as controlling the source of pollutants have been studied and put into effect. The purification of air in limited spaces is also an important consideration in many sophisticated and diverse fields. In particular, air purifiers which includes means for dealing with dust, smoke (especially tobacco smoke), ticks and pollen are essential to raise the yield at which such products as VLSIs (very large-scale integrated circuits) of a very high precision are produced through ultrafine, precise machining in the semiconductor industry. They are also absolutely necessary in operating and aseptic rooms, in bacteriological experiments, for furthering biotechnological research in food processing, and for improving the environmental hygiene in the home, working place and recreational facilities. The high-performance filters required are steadily being improved to deal with free-floating particles having a diameter of at least 0.3 micron, and is some cases 0.1 micron. Good results are gradually being obtained.

The dust collecting mechanisms employed in conventional air purifiers are classified roughly as being of the mechanical dust collecting or electrical dust collecting type, depending upon the operating principle. Generally speaking, the mechanical dust collecting systems are capable of trapping particles of a large diameter only and involve many difficulties in terms of installation and handling. These days the electrical dust collectors are the most commonly employed.

Electrical dust collecting systems include electrostatic dust collectors in which dust is trapped electrostatically upon being ionized by a corona discharge, and electrostatic induction-type air purifiers in which an electric field is applied across an inductor and dust is passed through the inductor to be trapped electrostatically. Let us first describe a conventional example of the former, namely the electrostatic dust collector, with reference to FIGS. 1 and 2.

FIG. 1 is useful in describing the dust collecting principle of the electrostatic dust collector. Floating particles contained in polluted air 1 pass through a filter 2 and are positively charged in a charging section 3 having a discharging wire 4 for effecting a corona discharge. The positively charged particles enter a collecting section 5 where they are repelled by high-voltage electrode plates 6 and trapped by grounded electrode plates 7. The apparatus thus provides purified air 8 from which the floating particles have been removed.

FIG. 2 is a sectional view illustrating an example of an electrostatic dust collector that employs the foregoing dust collecting principle. The dust collector includes a unit in which are assembled a discharge wire 10 and a discharge electrode plate 11, both having a positive potential, and a dust collecting electrode plate 12 having a negative potential. The unit is contained in a holder section 13 having a front side in which a front filter 14 is set, and a rear side in which a rear filter 15 and an activated carbon filter 16 for odor removal are installed. The unit with the attached filters is installed in a casing 17 through an intake port covered by a grill 18. A fan 19 and an outflow port 20 for the exiting air are provided in the rear portion of the casing 17.

Floating particles contained in polluted air are drawn in from the intake port by the fan 19, pass through the front filter 14 and are positively charged by the corona discharge wire 10. The positively charged particles are repelled by the discharge electrode plate 11, the potential whereof is positive, and are trapped by the dust collecting electrode plate 12, whose potential is negative. A stream of air so purified is blown out of the outflow port 20 upon passing through the rear filter 15 and activated carbon filter 16.

The latter air purifier of electrostatic induction type has already been disclosed in the specification of Japanese Patent Application Laid-Open No. 59-19564, filed by the inventor whose invention is described in the present application. This air purifier will now be discussed in detail with reference to FIGS. 3, 4, 5(*a*) and 5(*b*).

Let us first describe the dust collecting principle with reference to FIG. 3. The electrostatic induction-type air purifier includes an air-permeable, porous inductor 30 on which opposing electrodes 31, 32 are disposed and across which a high DC voltage is impressed to produce a strong electric field in the inductor 30, thereby trapping floating particles which attempt to pass through the pores in the inductor.

In terms of structure, the air purifier includes a filter element 41 arranged in the center of a case 40. Air containing pollutant particles is drawn into the case 40 from an inflow port 43 by a fan 42. To prevent the filter element 41 from becoming clogged, a filter bag 44 is disposed within the case 40 for trapping coarser dust particles. As shown in FIG. 5(*a*), the filter element 41 includes a filter member obtained by providing a thin film 48 of a metal such as aluminum comprising a first electrode on one side surface of a porous induction member 47 made of urethane foam or the like, and forming a metallic thin film 49 as a second electrode so that the induction member 47 is embraced by the electrodes. As shown in FIG. 5(*b*), a plurality of these filter members are wound into a cylindrical shape and a high voltage from a DC high-voltage power supply 45 (FIG. 4) is applied across the adjacent electrodes 48, 49 via terminals 48*a*, 49*b*. Numeral 47*a* denotes a screen for supporting the filter element 41.

In operation, floating particles drawn in from the intake port 43 are physically trapped in the air-permeable pores of the filter members. At the same time, a strong electrostatic field is generated by the inductors arranged between the positive and negative electrodes, thereby charging the floating particles. The particles so charged are trapped in the walls of the pores constituting the porous inductors.

The conventional electrostatic dust collector shown in FIGS. 1 and 2 has a number of drawbacks, which will now be set forth.

(1) Cleaning and maintenance are difficult.

Since the dust collecting effect diminishes when a large quantity of dust becomes attached to the dust collecting plates, a cleaning solution is prepared by dissolving a weakly alkaline cleaning agent in warm water at a temperature of about 60° C. The dust collecting unit is extracted from the opening of the grill 18 and the electrostatic collecting section, from which the front filter 14, rear filter 15 and activated carbon filter 16 have been detached, is immersed in the cleaning solution, usually for a period of about three hours, depending on the extent of contamination. The electrostatic collecting section is then shaken back and forth and from side to side while still immersed in the solution in order dislodge the contaminants. This must be done without touching the fine discharge wires 10. Any deposits on the dust collecting electrode plates 12 from smoke such as tobacco smoke are difficult to remove. If a brush or the like is used, care must be taken not to scrape the collecting plates.

(2) The trapped particles tend to re-scatter.

To trap particles with greater efficiency, either the applied voltage is raised or the portions to which the voltage is applied are increased in length. In either case, however, the trapped particles are re-scattered by a discharge which occurs due to concentration of the electric field at portions where the accumulated dust forms raised deposits on the collecting electrode plates.

(3) There is a tendency to produce radio wave interference.

When the corona discharge is generated, a high-frequency current flows into the ionized space, thus causing noisy radio reception.

(4) Ozone is produced.

The corona discharge is accompanied by the production of ozone, which can irritate or cause damage to mucous membranes.

The electrostatic induction-type air purifier illustrated in FIGS. 3, 5(*a*) and 5(*b*) also has a number of disadvantages.

(1) The purifier is uneconomical since the filter element is discarded with the strip-like electrode attached thereto when no longer usable.

(2) The apparatus cannot be made compact in size.

(3) The apparatus cannot be improved to withstand use in environments where the temperature and humidity are high.

SUMMARY OF THE INVENTION

An object of the present invention is to provide an electrostatic dust collector capable of collecting very fine dust efficiently without a short-circuit discharge caused by the application of a high voltage.

Another object of the present invention is to provide an electrostatic dust collector having an inexpensive filter element capable of being readily replaced.

A further object of the present invention is to provide an electrostatic dust collector which is low in cost and inexpensive to maintain.

According to the present invention, the foregoing objects are attained by providing an electrostatic dust collector comprising an electrode unit including first and second electrodes arranged to oppose each other across a solid insulator and having positive and negative potentials respectively applied thereto, the second electrode being so disposed that a leading edge portion thereof is located at a position inwardly of a leading edge portion of the first electrode; a gas passageway formed on a side of the second electrode opposite the first electrode; an electrically conductive filter element arranged in the gas passageway in contact with the second electrode; and forcible gas passing means for forcibly passing a gas to be purified through the gas passageway.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 3 is a view for describing the dust collecting principle of an electrostatic induction-type air purifier;

FIG. 4 is a sectional view illustrating an electrostatic induction-type dust collector employing the dust collecting principle of FIG. 3;

FIG. 5(*a*) is a view showing the construction of an electrode section of a filter element;

FIG. 5(*b*) is a perspective view of the filter element shown in FIG. 5(*a*);

FIG. 9(*b*) is a perspective view of another filter element of this type;

DESCRIPTION OF THE PREFERRED EMBODIMENTS

Preferred embodiments of the invention will now be described with reference to the drawings.

Figure 1:
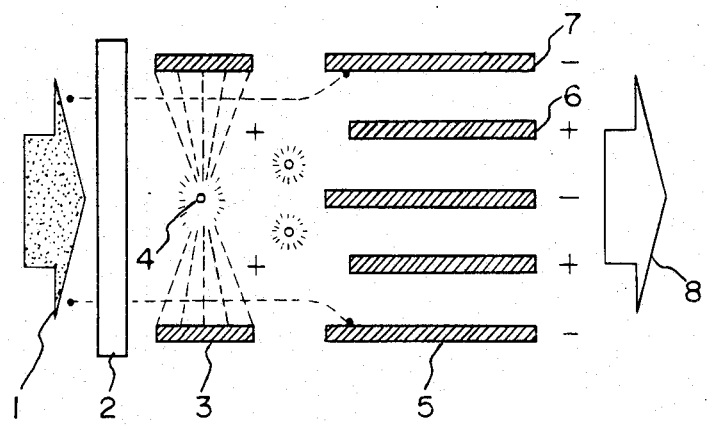
PRIOR ART Fig. 1
FIG. 1 is a view for describing the dust collecting principle of a conventional electrostatic dust collector.
Figure 2:
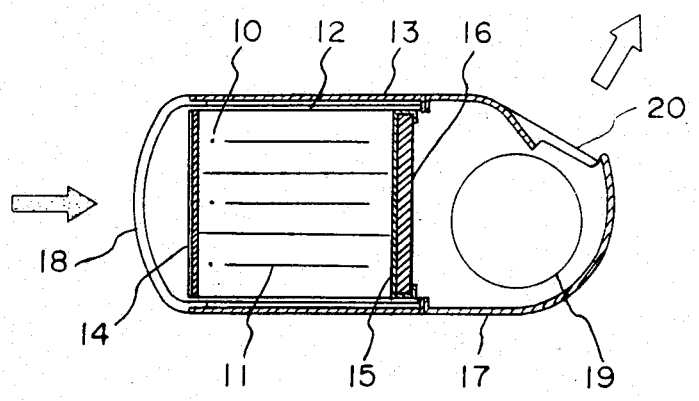
PRIOR ART Fig. 2
FIG. 2 is a sectional view illustrating an example of an electrostatic dust collector employing the dust collecting principle of FIG. 1.
Figure 6:
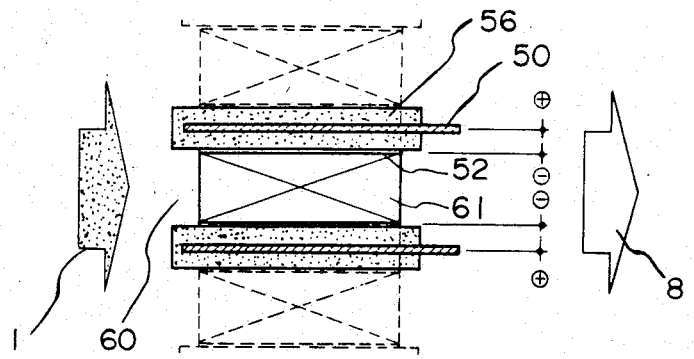
FIG. 6 is a view showing the construction of a principal portion of a dust collector according to the present invention.

The construction of a principal portion of an electrostatic dust collector according to the invention will be described with reference to FIG. 6.

A ceramic 56 serving as a solid insulator is provided about a first electrode 50 to which a positive DC high voltage is applied. A second electrode 52 to which a negative potential is applied is so provided as to sandwich the ceramic 56 between itself and the first electrode 50. The first electrode 50, second electrode 52 and ceramic 56 thus arranged constitute an electrode unit. The leading edge portion of the second electrode 52, namely the edge on the intake side of the apparatus, is located inwardly of the leading edge portion of the first electrode 50 so that the two edge portions do not overlap. The reason for this arrangement is to produce an edge effect on the intake side. The edge effect sets up an electric field at this portion of the apparatus to guide floating particles into a filter element, described below.

A gas passageway 60 for a gas to be purified, such as air, is defined between two electrode units constructed as set forth above. Arranged in the passageway 60 is a filter element 61, which comprises a metal wool consisting of extremely fine fibers of steel, aluminum, copper or the like, by way of example.

When air containing floating particles enters the passageway 60, the particles are guided to the filter element 61 by the electric field produced at the leading edge portion of the above-described electrode unit. When the floating particles reach the filter element 61, those positively charged are acted upon by Coulomb's force and are trapped by the fine fibers constituting the filter element 61. This is the result of an electrostatic induction effect among the numerous fibers that present a large surface area in the filter element 61, which is held at a negative potential owing to its contact with second electrode 52 having the negative potential applied thereto. In addition, the influx of floating particles is constricted when passing through the narrow voids formed by the fine pores in the mesh-like filter element, which is held at the negative potential, and the particles are caused to repeatedly collide with and contact one another, during which time they are charged. The particles eventually are trapped on the metal fibers of the filter element 61 by Coulomb's force. The trapped particles are held affixed by an electric charge supplied by the second electrode 52.

Figure 7:
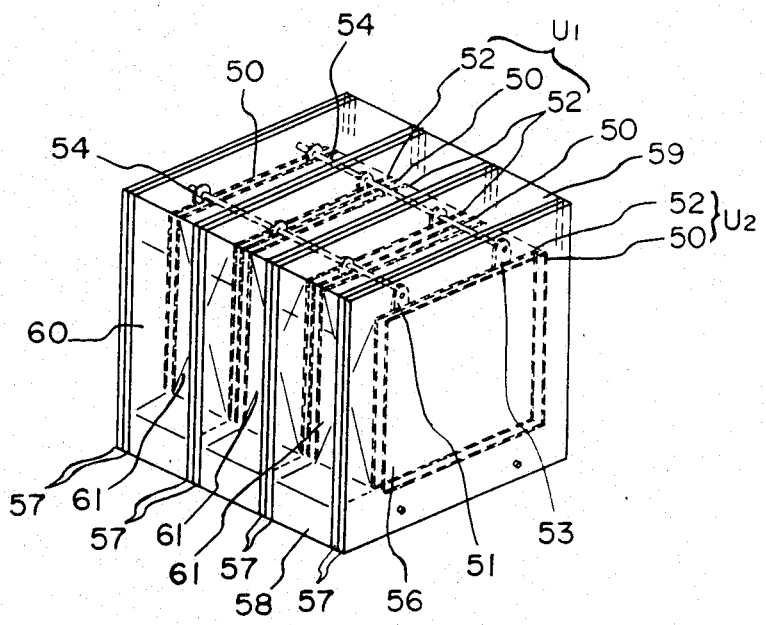
FIG. 7 is a perspective view illustrating an embodiment of an electrostatic dust collector according to the present invention.
Figure 8:
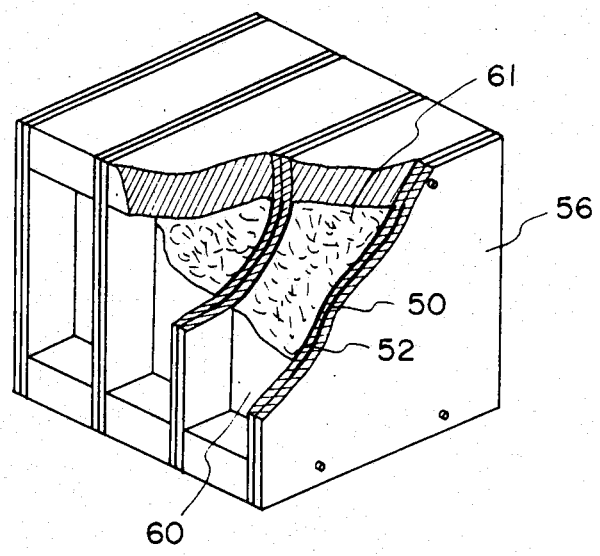
FIG. 8 is a perspective view, partially broken away, of a dust collecting section in the dust collector of FIG. 7.

In a preferred embodiment of the electrostatic dust collector shown in FIGS. 7 and 8, numeral 50 denotes the first electrode supplied with the positive DC high voltage, and numeral 56 designates the ceramic molded to enclose the first electrode 50. Arranged on both sides of the ceramic 56 are the second electrodes 52, to which a negative voltage is applied. These elements form a first electrode unit $U_1$. The leading edge portions of the second electrodes 52 are located inwardly of the leading edge portion of first electrode 50 so that an electric field is produced at these edge portions. A second electrode unit $U_2$ is provided with the first electrode 50 supplied with a positive high voltage, the second electrode 52 supplied with a negative voltage, and the ceramic 56 embraced by these electrodes. The first and second electrode units $U_1$, $U_2$ are assembled with a certain distance between them to form the passageway 60.

Figure 9A:
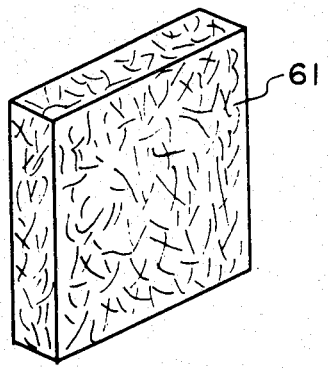
FIG. 9(*a*) is a perspective view of a filter element shown in FIG. 8.
Figure 9B:
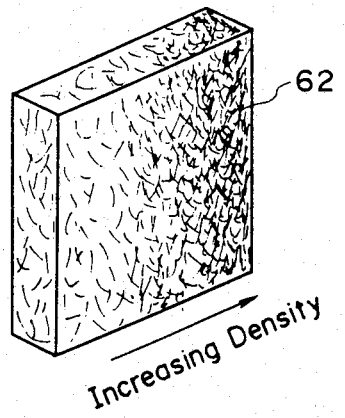

Provided between mutually adjacent ones of plural electrode units assembled as described above are partition plates 57, a lower spacer plate 58 and an upper spacer plate 59, whereby a plurality of passageways are formed. The electrodes 50, 52 are respectively provided with terminals 51, 53, and the terminals of like electrodes of the plural electrode units are interconnected by a conductor 54. Though a minimum of one passageway 60 will suffice, the dust collector can be designed to have a number of passageways suited to its capacity and application. Further, as shown in FIG. 9(*a*), the filter element 61 is shaped beforehand so as to conform to the configuration of the passageway 60. It is also possible to employ a filter element of the kind depicted in FIG. 9(*b*). Here the metal fibers of the filter element, designated by numeral 62, are distributed coarsely at the leading edge portion, which is on the intake side of the passageway, but the distribution becomes gradually denser as the outflow side is approached. This makes it possible to collect a uniform amount of dust across the entirety of the filter element 62.

An electrostatic dust collector embodying the present invention will now be described in detail with reference to FIGS. 10 and 11.

Figure 10:
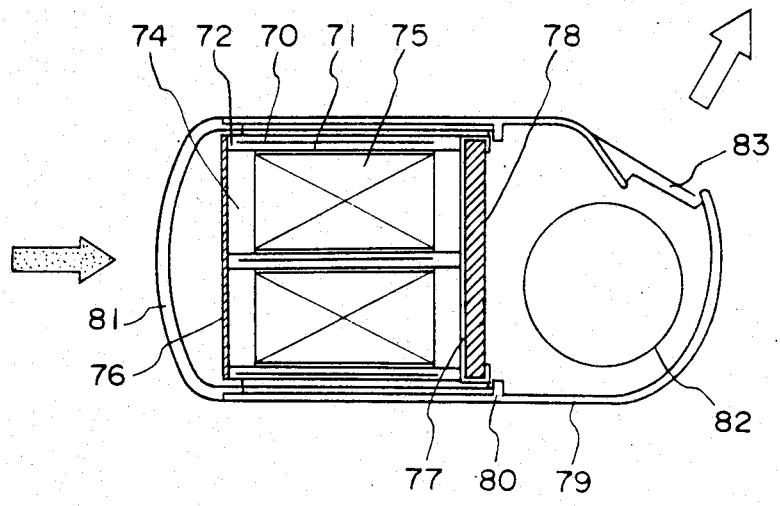
FIG. 10 is a sectional view of the electrostatic dust collector according to the present invention.
Figure 11:
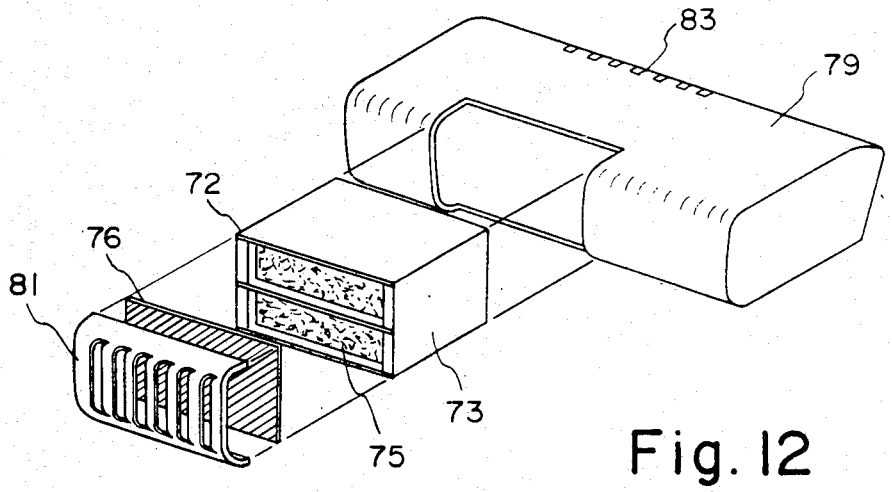
FIG. 11 is an exploded perspective view of the electrostatic dust collector shown in FIG. 10.

In FIGS. 10 and 11, numeral 70 denotes the first electrode to which the positive DC high voltage is applied, 71 the second electrode to which the negative voltage is applied, and 72 the ceramic serving as the solid insulator enclosing the first electrode 70. The electrodes 70, 71 and the ceramic 72 form an electrode unit. The leading edge portion of the second electrode 71 in the electrode unit is arranged at a position inwardly of the leading edge portion of the first electrode 70. Numeral 73 denotes a side plate, 74 a gas passageway, 75 a filter element installed in the passageway 74, 76 a prefilter for trapping coarse dust particles in order to prevent clogging of the filter element 75, 77 a rear filter, which serves also as a holder for an activated carbon filter 78, 79 a case body, 80 a stopper, 81 a grill, 82 a fan, and 83 an outflow port.

Figure 12:
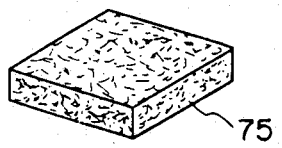
FIG. 12 is a perspective view of a filter element shown in FIG. 11.

Air or any other gas containing floating particles is drawn in through the grill 81 at the intake port by the fan 82 and reaches the dust collecting unit via the prefilter 76. The dust collecting unit accommodates the filter element 75, which comprises a metal wool of steel, aluminum, copper or the like, or a sponge consisting of an electrically conductive plastic. As shown in FIG. 12, the filter element 75 is shaped beforehand to conform to the configuration of the passageway 74 to facilitate its insertion into the passageway. The assembled dust collecting unit inclusive of the filter element 75 is installed in the case body 79 by being pushed in from the intake port of grill 81 until it abuts against the stopper 80 located within the case body. The fan 82 and the outflow port 83 for the purified air are provided in the rear portion of the case body 79 in back of the filter 78.

In operation, air or any other gas containing floating particles is drawn in through the grill 81 at the intake port by the fan 82. The coarse particles are trapped by the prefilter 76. The finer particles that pass through prefilter 76 are acted upon by the electric field at the leading edge portions of the electrodes 70, 71 to be guided into the filter element 75, which is held at the negative potential. As a result, the entrant particles are subjected to the above-described dust collecting action and, hence, are trapped by the multiplicity of filter element fibers, which present a large surface area. Air thus purified is deodorized by the activated carbon filter 78 before being blown out of the outflow port 83.

Another embodiment of the electrostatic dust collector of the present invention will now be described in detail with reference to FIGS. 13 and 14.

Here a first electrode 90 has a cylindrical configuration. Disposed on the inner surface of the first electrode 90 in coaxial relation with the first electrode is a cylindrical ceramic 92. A second electrode 91 is formed on the inner surface of the ceramic 92 and has a cylindrical configuration, the second electrode being in coaxial relation with the ceramic 92. Thus, the first and second electrodes 90, 91 are of cylindrical form and are disposed in coaxial relation with the cylindrical ceramic, which is sandwiched between them. The leading edge portion of the second electrode 91 is located inwardly of the leading edge portion of the first electrode 91. Defined within the cylindrical second electrode 91 is a space serving as a gas passageway 95, in which a filter element 96 shaped beforehand into a cylindrical configuration is arranged. The first and second electrodes 90, 91 have terminals 93, 94, across which a high-voltage DC power supply 97 is connected. A motor-driven fan 98 is arranged at the trailing ends of the electrodes. Operation is the same as that set forth above.

Figure 13:
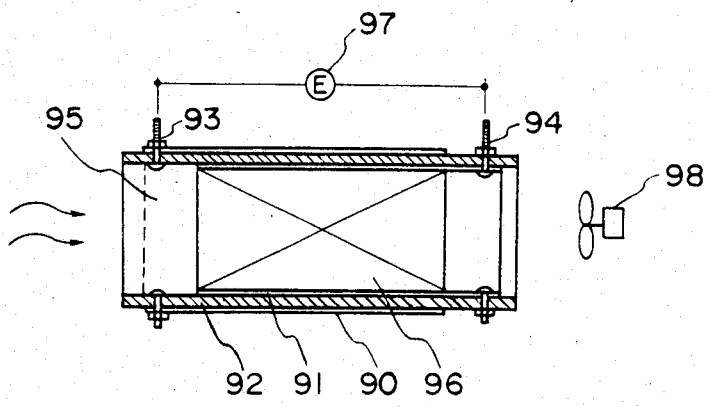
FIG. 13 is a sectional view illustrating another embodiment of an electrostatic dust collector according to the present invention.
Figure 14:
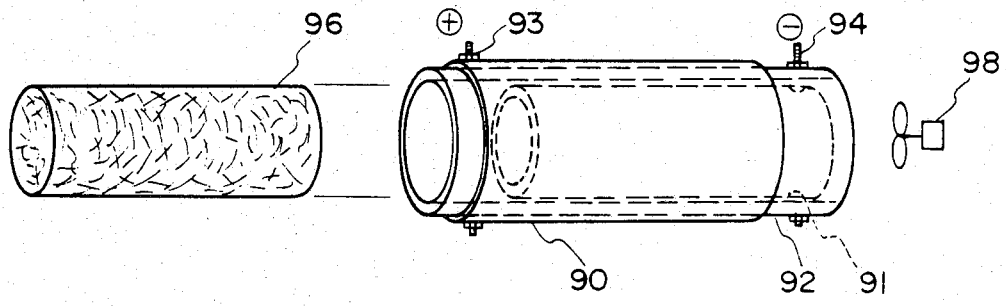
FIG. 14 is a perspective view of the dust collector shown in FIG. 13.
Figure 15:
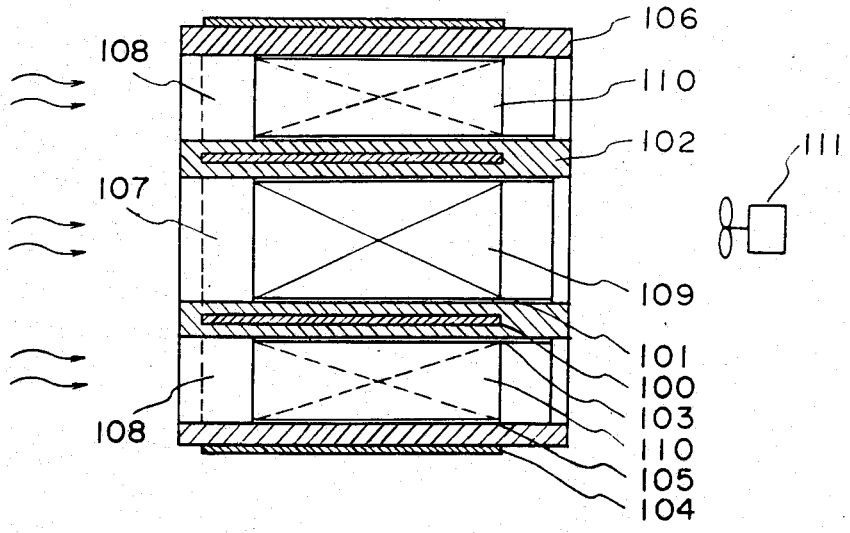
FIG. 15 is a sectional view illustrating a further embodiment of an electrostatic dust collector according to the present invention.

In the embodiment of FIGS. 13 and 14, only one electrode unit is shown. However, it is possible to adopt an arrangement in which a plurality of electrode units are disposed coaxially. For example, as illustrated in FIG. 15, it is possible to adopt an arrangement having a centrally located cylindrical first electrode 100, a cylindrical ceramic 102 formed to enclose the first electrode 100, a second electrode 101 arranged on the inner circumferential surface of the ceramic 102, a second electrode 103 arranged on the outer circumferential surface of the ceramic 102, a cylindrical first electrode 104 provided on the outer side of the second electrodes 101, 103, a cylindrical ceramic 106 provided on the inner side of the first electrode 104, a cylindrical second electrode 105 provided on the inner side of the ceramic 106, a filter element 109 arranged in a central gas passageway 107 defined within the first electrode 100, and a filter element 110 arranged in a gas passageway 108 encircling the gas passageway 107 and coaxial therewith. Numeral 111 denotes a motor-driven fan. A multiple filtration system of this type is effective for use as an emergency dust collector in nuclear reactors, fuel storage facilities and the like.

If steel wool is used as the filter element material, the filter will act to chemically adsorb such compounds as $SO_2$ and $NO_x$ to achieve a greater degree of purification of the gas that passes through the filter element. In addition, using steel wool allows the filter element to be employed in a high-temperature environment.

Furthermore, the magnitude and distribution of the electric field generated at the leading edge portion of the above-described electrode unit is dependent upon the voltage applied across the electrodes or the density of the fibers at the leading edge portion of the filter element.

Though the solid insulator has been described as being a ceramic, any material which exhibits a high insulation breakdown resistance and mechanical strength can be used. One example is epoxy resin. If the latter is adopted, a slender electrode unit can be readily fabricated by forming an electrode comprising a thin metal film on the surface of a plate or sheet of the epoxy resin.

As many apparently widely different embodiments of the present invention can be made without departing from the spirit and scope thereof, it is to be understood that the invention is not limited to the specific embodiments thereof except as defined in the appended claims.

The present invention, described in detail hereinabove, has a number of important advantages.

(1) A material such as the ceramic or epoxy resin interposed between the electrodes exhibits a high degree of insulation, and dust removed from the entrant gas does not form a deposit on both electrodes. Therefore, despite the fact that a high DC voltage is applied across the electrodes, a short-circuit discharge can be prevented and both radio wave interference and the generation of ozone can be reduced.

(2) The filter element in contact with the dust collecting electrode is held at the same potential as this electrode and presents a very large surface area, so that floating particles contained in the air passing through the filter element are trapped by electrostatic induction. Accordingly, the particles are collected very efficiently both by the physical filtering action of the filter element itself and by electrostatic induction.

(3) Particles trapped by the filter element are held affixed by the electric charge from the electrode unit.

(4) The electrode unit having the electrodes which oppose each other across the solid insulator is of a simple and rigid structure and low in cost.

(5) Since the materials constituting the dust collector exhibit a high resistance to heat, the dust collector can fully withstand use in high-temperature environments.

(6) The overall apparatus can be made compact in size.

(7) The filter element is extracted from the gas passageway before its dust collecting efficiency declines and is replaced merely by inserting a new filter element in the passageway. Accordingly, the filter element is readily replaceable.

(8) The dust collector can be restored to its original performance merely by replacing the filter element.

(9) A metal wool such as of steel, aluminum or copper can be used as the filter element. Such a filter element is low in price and makes it possible to reduce maintenance costs. In particular, these metal wools provide a large surface area in the gas passageway to provide a high dust collecting efficiency.

(10) If steel wool is adopted as the filter element material, compounds such as $SO_2$ and $NO_x$ are chemically adsorbed to further purify the gas that passes through the filter.

(11) If steel wool is used as the filter element, a used filter element can be discarded without fear of pollution since the steel wool will rapidly oxidize and break down in a natural manner due to oxygen and water contained in the air.

What we claim is:

1. An electrostatic dust collector for removing particles from a gas to be purified, comprising:

an electrode unit including a first electrode, a second electrode and a solid insulator, said first and second electrodes being arranged to oppose each other across said solid insulator and having positive and negative potentials respectively applied thereto, said second electrode being so disposed that a leading edge portion thereof is located at a position inwardly of a leading edge portion of said first electrode;

a gas passageway formed on a side of said second electrode which is opposite said first electrode;

an electrically conductive filter element arranged in said gas passageway so as to be in contact with said second electrode; and forcible gas passing means for forcibly passing the gas to be purified through said gas passageway.

2. The electrostatic dust collector according to claim 1, wherein a plurality of dust collecting units are juxtaposed in parallel, each dust collecting unit comprising said electrode unit, said gas passageway and said filter element.

3. The electrostatic dust collector according to claim 2, wherein said plurality of dust collecting units juxtaposed in parallel includes a dust collecting unit disposed on an inner side thereof, the first electrode of said last-mentioned dust collecting unit being enclosed within said solid insulator, and the second electrode being arranged on both sides of said solid insulator.

4. The electrostatic dust collector according to claim 1, wherein said first and second electrodes are flat plates arranged to lie parallel to each other.

5. The electrostatic dust collector according to claim 1, wherein said first and second electrodes are cylinders arranged in coaxial relation.

6. The electrostatic dust collector according to claim 1, wherein said filter element is shaped in advance so as to conform to the shape of said gas passageway.

7. The electrostatic dust collector according to claim 1, wherein said filter element comprises metallic wool.

8. The electrostatic dust collector according to claim 7, wherein said metallic wool is made of steel.

9. The electrostatic dust collector according to claim 1, wherein said forcible air passing means is a motor-driven fan provided at a rearmost portion of said gas passageway.

10. The electrostatic dust collector according to claim 1, further comprising a prefilter provided at a forward portion of said gas passageway.

11. The electrostatic dust collector according to claim 1, further comprising an activated carbon filter provided at a rearward portion of said gas passageway.

12. The electrostatic dust collector according to claim 1, wherein said solid insulator comprises a ceramic.

13. The electrostatic dust collector according to claim 1, wherein said solid insulator comprises an epoxy resin.

* * * * *